US010001301B2

(12) United States Patent
Daviet

(10) Patent No.: US 10,001,301 B2
(45) Date of Patent: Jun. 19, 2018

(54) AUTOMATED, OSCILLATING DUAL-CHAMBERED HEAT PUMP, ELECTRICITY GENERATING, AND/OR WATER HEATING METHOD EMPLOYING SUCH

(71) Applicant: Brad Daviet, Memphis, TN (US)

(72) Inventor: Brad Daviet, Memphis, TN (US)

( * ) Notice: Subject to any disclaimer, the term of this patent is extended or adjusted under 35 U.S.C. 154(b) by 694 days.

(21) Appl. No.: 14/543,891

(22) Filed: Nov. 17, 2014

(65) Prior Publication Data

US 2016/0138522 A1 May 19, 2016

(51) Int. Cl.

| | |
|---|---|
| ***F02G 1/043*** | (2006.01) |
| ***F25B 9/00*** | (2006.01) |
| ***F28F 5/00*** | (2006.01) |
| ***F28D 7/02*** | (2006.01) |
| ***F28D 11/04*** | (2006.01) |
| *F24H 1/22* | (2006.01) |

(52) U.S. Cl.

CPC ..... *F25B 9/00* (2013.01); *F28D 7/028* (2013.01); *F28D 11/04* (2013.01); *F28F 5/00* (2013.01); *F24H 1/22* (2013.01)

(58) Field of Classification Search

CPC ..... F28F 5/00

USPC ..... 126/641

See application file for complete search history.

(56) References Cited

U.S. PATENT DOCUMENTS 2,911,919 A * 11/1959 Tucker ..... F04D 29/108 310/55
3,287,901 A 11/1966 Tauer
3,715,885 A 2/1973 Schur
3,767,325 A * 10/1973 Schuman ..... F02G 1/0435 417/207

(Continued)

FOREIGN PATENT DOCUMENTS

CN 102562195 A 7/2012

OTHER PUBLICATIONS

The United States Patent and Trademark Office; The International Search Report and the Written Opinion of the International Searching Authority; search report and written opinion; dated Jan. 28, 2016; pp. 1-10; The United States Patent and Trademark Office; USA.

*Primary Examiner* — Avinash Savani
(74) *Attorney, Agent, or Firm* — Wyatt, Tarrant & Combs, LLP; Stephen C. Hall

(57) ABSTRACT

Heat pump configurations that provide continuous heat transfer capabilities without any need for electricity. The overall system includes a rotatable hourglass structure situated within a sphere or ovoid container with internal tracks aligned with wheels on the hourglass. With a heat collection component situated on the underside of the container, the rotatable hourglass, being constructed of suitable heat transfer materials, absorb the collected heat in the lower portion of the container, thereby causing the air present therein to expand, forcing a plunger upward from one hourglass chamber to the other. The plunger effectuates operation of a (Continued)

magnetic switch to release the hourglass to rotate and then oscillate from one position to another until the heat collection operation discontinues. With a coolant introduced within the heated chamber (and drawn through pressure differential), heat can be transferred thereto. The heated coolant is then transferred to a reservoir for future utilization.

5 Claims, 13 Drawing Sheets

(56) References Cited

U.S. PATENT DOCUMENTS

| | | | |
|---|---|---|---|
| 3,861,166 | A | 1/1975 | Goldsberry |
| 3,991,575 | A | 11/1976 | Bailey et al. |
| 4,141,218 | A | 2/1979 | Rayboy |
| 4,199,952 | A | 4/1980 | Berg |
| 4,281,969 | A | 8/1981 | Doub, Jr. |
| 4,805,410 | A | 2/1989 | Johnston |
| 5,203,172 | A | 4/1993 | Simpson et al. |
| 5,257,660 | A | 11/1993 | Cargile |
| 7,823,405 | B2 | 11/2010 | Williams |
| 8,156,739 | B2 | 4/2012 | Johnston |
| 8,272,851 | B2 | 9/2012 | Lucas |
| 8,459,028 | B2 | 6/2013 | Klassen et al. |
| 2011/0315183 | A1 | 12/2011 | Henness |

* cited by examiner

Front View

Top View

Side View

Front View

Side View

Front View

Side View

AUTOMATED, OSCILLATING DUAL-CHAMBERED HEAT PUMP, ELECTRICITY GENERATING, AND/OR WATER HEATING METHOD EMPLOYING SUCH

FIELD OF THE INVENTION

This invention relates to heat pump configurations that provide continuous heat transfer capabilities without any need for electricity. The overall system includes a rotatable hourglass structure situated within a sphere or ovoid container with a mid-point cross arm to permit 180° rotation. With a heat collection component situated on the underside of the container, the rotatable hourglass, being constructed of suitable heat transfer materials, absorb the collected heat in the lower portion of the container, thereby causing the air present within to expand, forcing a plunger upward from one hourglass chamber to the other. With complete upward movement completed, the plunger effectuates operation of a magnetic switch to initiate rotation of the hourglass; upon movement of the plunger upward thereafter, the hourglass oscillates from one position to another until the heat collection operation discontinues. With a coolant (water, for instance) introduced within the heated chamber (and drawn through pressure differential due to heat intake), heat can be transferred thereto. The heated coolant is then transferred to a reservoir for future utilization. With this configuration, the plunger motion and the attached magnets may be utilized for heat and pressure purposes, potential electricity generation, as well as other activities, including, without limitation, fluid transport and desalination of sea water. Thus, the overall configuration as well as the utilization and application of such a device for any such purpose is also encompassed herein.

BACKGROUND OF THE PRIOR ART

Heat transfer has proven to be rather difficult to control for many years. The ability, for instance, to generate a continuous flame under a water vessel requires not only noticeable safety considerations, but a continuous supply of material to burn for such a purpose. Certainly, natural gas can be utilized within such a system, but the costs and controlled dispensing of such a gaseous source requires significant investment and precautions (not to mention, electricity for control purposes). Typical water heaters rely upon natural gas or electricity nowadays, incurring significant costs and, for the most part, rather inefficient results, particularly as the price of natural gas increases. Additionally, with the drive for more green energy alternatives around the globe, the ability to supply hot water on demand without the need for electricity (which is primarily generated through the burning of fossil fuels for the most part) has, again, proven to be extremely difficult.

Solar energy has recently been employed for water heating purposes to a greater extent, albeit in a rather limited fashion as continuous supply is limited due to obvious availability constraints. Furthermore, even with a generous supply of heat captured in such manner, the actual transfer operation typically relies upon an electric pump device or, ultimately, induction through the flow of hot air around a water source. Electric pumps require, as noted above, electricity for operation, leaving such a system susceptible to inactivity if such an electrical supply is curtailed. Likewise, temperature controls can be difficult to employ without undertaking certain computerized controls (again requiring electrical charges for operation). Such air flow devices are extremely inefficient as the general supply of heat in terms of solar activity has proven difficult to sufficiently control, leaving a rather large amount of collected heat subject to emission as "waste" since, for example, the total amount must be stored or immediately transferred unless dissipation occurs over time.

In effect, solar or waste energy in such situations is stored within liquid as heat or additional potential energy, thus providing a significant and heretofore untapped capacity for efficient utilization if handled properly. In that manner, then, the retention of the total heat absorbed in such a situation is impractical with typical solar energy collectors/distributors, as well. Collection and utilization of all (or even a majority) of transferred heat within such systems are simply not available without the need for electrical resources for storage and control purposes. Avoidance of such electrical needs is very important for a green technology device to be utilized without need for a carbon footprint, let alone the potential for human involvement for maintenance and upkeep of any such electrically based instrumentation.

There thus exists a noticeable need to supply suitable heat transfer capabilities with minimal (or even no) electricity requirements, particularly as it pertains to supplying heated water on demand. As noted above, the current state of the art is generally based upon electrical, natural gas, or combinations thereof, for such purposes. Any flame-based operations require emissions controls as well as safety measures to best ensure explosions do not occur (particularly with highly flammable natural gas supplies). Even propane and other like gases have proven difficult and potentially dangerous in these respects. As such, it remains a highly desirable result to avoid, if possible, any need for open flame or electrical reliance for such heat transfer activities. Any capability to do so that is continuous without any need for any appreciable level of human involvement for sufficient operation would thus be of significance to these industries. To date, such a self-acting system has yet to be provided.

ADVANTAGES AND SUMMARY OF THE INVENTION

It is thus one significant advantage of the present invention that heat transfer of most collected thermal energy may be utilized to supply heat to a coolant (such as water) continuously. Another advantage is the ability to collect heat from any source and transfer most (if not all) such heat to a coolant supply, regardless of the degree of thermal energy involved. Yet another advantage is the beneficial capability of operating such a heat transfer method through a system that requires no electricity or human involvement for proper functioning (and even monitoring). The ability to introduce such an inventive system in any location that is conducive to a standard heat pump presence is yet another advantage of this invention, thereby allowing great versatility of the entire system in any geographic location. Still another advantage is the capability of such a base automated oscillating device to generate electricity, transport fluids, aid in desalinating sea water, all without any need for electricity or other like power source.

Accordingly, this invention encompasses a heat transfer system including an oscillating dual-chambered device that automatically switches from positions in terms of disposition of one chamber vertically aligned and above the other chamber dependent upon the collection and absorption of heat by the lower vertically chamber until such lower vertically aligned chamber absorbs sufficient heat to generate a pressure differential between itself and the upper vertically aligned chamber, whereupon said chambers rotate and switch positions until that lower chamber attains the necessary pressure level to activate the rotation to its initial position; wherein said device include a coolant line around both chambers that absorbs substantially all the heat collected within the lower aligned chamber at one time after said chamber has rotated to its upper position. Such a device including an activated plunger that oscillates back and forth dependent on said pressure differentials due to such heat level differences between the two chambers is also encompassed herein, as is such a plunger having two opposing magnetic structures on opposite ends that acts in concert with an external magnetic switch to release said oscillating dual-chambered device to permit rotation and catch thereof until said magnetic switch is activated upon sufficient magnetic signal from said plunger subsequently. The device including a coolant line that permits a single direction of coolant movement into and then out of said device, wherein said line wraps around said dual-chambered device to allow for heat transfer from said device to said coolant line, is also encompassed herein. Additionally, the overall system with a multi-rod heat collection device disposed, at all times, below said dual-chambered device, is also encompassed herein. The presence of magnets at the extreme ends of the plunger device activate a rotation switch when instantly aligned with external magnets at the top of the sphere, with the potential for alternating magnets aligned along the middle portion of the plunger device to activate a pressure pump to overcome any gravitational and/or frictional resistance to coolant flow. The method of effectuating proper heat transfer from a heat source to said heat collection device to said lower aligned chamber of said dual-chambered, rotatable device to said coolant line and then to said coolant, for storage of heated coolant within a reservoir, is thus also contemplated herein. The overall system is thus discussed in greater detail below.

Overall, the system functions in relation to Boyle's Law, wherein, within a closed system, the pressure of a gas is inversely proportional to its volume. With temperature changes, the gas volume increases (through expansion), thereby increasing the pressure. In such a situation, the gradual increase in temperature allows for pressure to also increase; coupled to a separate chamber that is not subject to the same temperature increase, the potential to access the pressure build up to provide a continuously moving component between such separate chambers that reacts to such pressure changes, it was realized that a non-electric system could be accomplished for a heat pump device. In essence, the ability to provide two distinct, but connected, chambers, each preferably, though not necessarily, in conical or pyramidal shape, with a movable plunger disposed between both chambers within an air-tight hole, allows for the introduction of heat to the lower chamber which thereby increases the pressures therein. In this manner, the plunger gradually moves upward through the hole into the upper chamber since the plunger is forced by the expanding air within the heated, lower chamber to move in such a fashion. With magnets present in opposing fashion on the ends of the straight plunger, and also with caps present in such ends to prevent further movement of the plunger into either chamber during such a heat collection event, proper alignment of such magnet ends with a suitably situated and magnetically aligned switch external to the hourglass provides the potential to automatically activate such a switch that allows for magnetic forces to initiate such rotation. Upon half rotation (180° from starting point), the hourglass will stop to allow for heat-collection and transfer forcing the now downwardly situated plunger to rise in relation to the pressures generated therein to then have the magnetic end interact with the repulsion force of the external magnets within the sphere to turn the hourglass back in the same direction and start the heat collection/pressure build again. This oscillation capability continues unabated until the heat collected is less than the latent heat within the hourglass itself.

The heat collection device is provided externally to the sphere in standard form. Whether by solar collection capacity (and, with this overall device, the heat collected thereby is not converted to any other source, but is actually utilized to provide the actual hourglass movement and, if desired, the heat transferred to the subject coolant) or, when the sun exposure is not available, extraction of heat from the surrounding atmosphere, such a heat collection component imparts a wide range of heat transfer potential. With the standard that heat and/or hot air rises, the sphere (or ovoid) is placed over the heat collection component for best results. The sphere may directly permit transfer (with, for instance, openings within the base thereof) or may further include an internal component that allows for transfer from the external device to the internal portion of the sphere and then to the hourglass, itself. Thus, as one non-limiting example, a flexible heat transfer gel (with a resilient and/or low-friction skin, again, as one non-limiting example) may be employed in the lower portion of the sphere (or ovoid) and be situated above the interior of the sphere and below the lowest level of the hourglass, or to permit contact with the hourglass. The flexible nature thereof the gel (and the possible resilient skin) allows the hourglass to skim the surface of the gel during rotation as well. Such a gel may be provided with a metal slug therein to attract the plunger device during rotation. When the plunger rises due to heat and air pressure increases, the attraction forces are reduced; when the plunger reaches its highest point and activates the magnetic "kick" to rotate the hourglass, the plunger is thus positioned at its lowest level when such a rotation action finishes (ostensibly with the magnetic end positioned over the gel-encased metal slug). Also potentially present within the gel are metal particles of differing sizes, if desired, to provide further capacity to attract the plunger end thereto and assure complete half-rotation of the hourglass occurs as needed, as well as provide further heat transfer potential. The gel may thus, as noted above, be situated in such a manner as to contact the hourglass when rotated into direct alignment over the heat collection device. Again, to permit such an activity, the gel should exhibit suitable flexibility and rebound (as well as durability) without erupting and thus leaking into the sphere itself. It is possible, however, that the gel may be supplied in a certain amount within the bottom of the sphere (or ovoid) with the metal particles and metal slug (or slugs) in place without any skin on its surface. In this manner, the gel should exhibit a suitable non-tacky characteristic, however, such that it permits hourglass movement therethrough without attaching or otherwise causing undesirable friction during such hourglass manipulation.

To permit effective hourglass rotation and best ensure such movement resolves at a 180° point from its initiation, in addition to and/or as an alternative to the attractive potential of metal particles and metal slug(s) within the gel, the hourglass structure may also include post extensions from chambers of the hourglass that act as catches in relation to posts provided within the interior of the sphere or ovoid. Such posts (or extended arms) extend outwardly in a manner that allows free rotation of the hourglass and does not entangle or otherwise catch on any other component within the sphere or ovoid other than the interior posts themselves.

Such posts are thus situated to extend upward from a lower portion of the sphere or ovoid and are positioned in opposing regions thereof but at different heights and/or distances from the hourglass itself. In this manner, the extended arms may be configured with different structures from the hourglass such that a first arm (attached and extending from chamber exterior) will catch on its complementary interior post and, if needed, return over the gel component. The other will thus only catch on its complementary interior post for the same purpose. Since the hourglass returns in the same direction during its rotations, the different positions and structures of the arms and posts allow for such free movement until the subject arm catches with its complementary interior post. Such arms may thus include different lengths with each interior post situated at specific distances within the sphere interior to allow one arm to catch during a rotation and the other not, and vice-versa. Likewise, one arm may be configured with a half-loop, for instance, structure that avoids one interior post but catches on the other, while the other arm is of a length that avoids the interior post associated with the half-loop arm, but catches on the closer distance interior post.

The rotatable dual-chambered device may be situated within a container or vessel that can be closed and that allows access to such parts on demand, if necessary. The enclosure itself is preferably transparent to permit continuous views of the dual-chambered device; of course, if desired, an opaque structure may also be employed, or even an enclosure that is partially transparent and partially opaque. This enclosure provides the internal surface to which a track (or tracks) may be situated to facilitate the rotation of the dual-chambered device during operation. Additionally, it also provides a means to best provide an external coolant line that passes through the enclosure wall and more easily functions to permit heat transfer therein from the heated chamber to the coolant itself. Such an enclosure further provides protection to the dual-chambered device from the elements, a means to provide a rotating base dowel (or like object) that allows for such rotation to occur, and protection of the magnetic switch, as well as a mounting structure on which such a switch may be situated and aligned for activation in relation to the dual-chambered plunger component.

This basic dual-chambered device may be coupled to any type of heat collector means as long as heat transfer capabilities related thereto are accomplished at a location that is below the entirety of the enclosure. In essence, the heat collection operation accords the ability to direct and conduct heat through the enclosure to the lower chamber (at that specific time; again, as the lower chamber increases in temperature and pressure, once the optimal level is met the chambers will rotate around a set axis to permit the previously upper chamber to then be exposed to such a heat transfer situation), primarily, if not solely. The heat collection continues indefinitely and may be configured in relation to any type of heat source as well as exhibiting the ability to shift heat collection capability from one source to another. For instance, solar heat may be provided through a plurality of mirrors, directing thermal energy to a specific location at which the heat collectors are present. In this manner, the collectors continue to transfer and conduct heat upwardly to the enclosure and thus to the lower chamber. When solar access is not possible (e.g., at night or if clouds obscure the solar beams), the collectors may also be able to extract heat from the surrounding atmosphere and/or environment in order to continue the heat transfer operations, albeit in a slower fashion as the temperature rise will assuredly be less noticeable than during a solar power access event. Such heat collectors may be, as alluded to above, any typical structure or device that absorbs heat and transfers such (through induction, conduction, or otherwise) to a different material (in other words acts as a collector and a conduit, simultaneously). As examples, heat collecting rods (similar to those present in nuclear power plants), present in similar or differing lengths and structures, and made from copper or a similarly heat conductive metal or alloy, may be utilized for such a purpose.

The enclosure itself, beyond its preferable transparent state, must be able to attach to such heat collectors and not melt or appreciably distort in relation to the high temperatures associated with such a heat pump situation. As well, it must also allow for transfer of heat from the collectors to the dual-chambered device without interfering or otherwise reducing or dissipating the heat levels associated therewith, either. Thus, a plastic (such as carbon fiber reinforced polymer, polyaramide, polystyrene, or polyisocyanurate, as non-limiting example) is preferably utilized for this purpose. Such a plastic allows for a hinge to be present to permit opening of the enclosure for access purposes (if needed) for the device and the other component parts located therein, as well as the ability to either have constructed therein or attached thereto tracks that permit the rotation of the dual-chambered device as necessary for the continuous oscillation operations to commence. Generally, such an enclosure will not be structured symmetrically with the hinge centrally located. Due to the totality of components needed for effective operation without any electricity or human involvement, the enclosure will allow for the dual-chambered device to be present within the larger area of the enclosure (which may be spherical or ovoid in configuration, as noted above), allowing for the remaining components to easily be placed in the other areas therein. As well, the enclosure should also allow for openings to insert coolant lines, both in terms of enclosure ingress and egress, to permit the actual heating of the coolant formulation (whether water or other type of fluid, such as, for instance, toluene, alcohols, and the like) and transfer thereof to a suitable storage reservoir thereafter. Furthermore, the enclosure structure should also include an inner lip on the larger half portion that permits placement of a spoke that functions as the rotating axis for the dual-chambered device. Such a spoke may be easily removed if maintenance is required on the dual-chambered device, too. The enclosure may further include a locking mechanism, as well, to ensure the entirety will remain in place and in motion during operation.

In terms of the actual coolant lines employed herein, such are provided with properly insulated structures that exhibit heat transfer capacity. The ingress lines initiate from a coolant supply and lead directly to the upper hemisphere of the enclosure. As alluded to above, openings within the enclosure are provided to insert such lines therethrough for access to the dual-chambered device. The ingress line (which may be provided as a single line or in split fashion to allow for selective access to either chamber on demand) includes a one-way valve that opens when vacuum pressures are applied allowing for the ingress movement of the coolant into the enclosure. Basically, the heat intake at the interface with the dual-chambered device creates a pressure differential that continuously draws the coolant forward to the heat transfer location. The one-way valve structures thus allow for such forward movement, but close if opposing movement exists. In this manner, the coolant supply cannot retreat from the enclosure, but, with the heat increase continuously occurring for at least one of the rotating chambers, will continue to move forward for access to the heat transfer interface. With lower heat levels transferred from the collectors to the lower chamber, then, the rate of coolant introduction will also be reduced. In effect, the coolant introduction rate is thus also dictated by the rate of heat transfer, thereby consistently providing the same basic level of heat increase to the coolant supply as it passes over the dual-chambered device, achieving appreciably the same level of heating to the entirety of the coolant that is then stored for later use.

As noted, the coolant lines enter the enclosure and then contact the dual-chambered device capturing a large majority of the heat which enters the heat exchanger. By switching configuration to a large volume heat exchanger, the primary receiver of the plunger energy will be the heated coolant. With minimal volume in the heat exchanger, more pressure will be created by the additional activitations of the pump switch, but less heating of the coolant will occur.

DETAILED DESCRIPTION OF THE PREFERRED EMBODIMENTS AND DRAWINGS

Without any intention of limiting the breadth and scope of the overall inventive method, the following descriptions of the accompanying drawings provide certain non-limiting but potentially preferred embodiments of the structure and process of utilization of the aforementioned inventive dual-chambered automatic oscillating heat pump.

As noted above, the inventive device automatically oscillates in relation to heat transfer and magnetic force applications. As such, although the description herein is of a heat pump (ostensibly since heat is collected and transferred for operation), it should be evident that such a device may be utilized for any purpose wherein kinetic energy translates to any manner of power generation, fluid transfer, or other like purpose.

Figure 1:
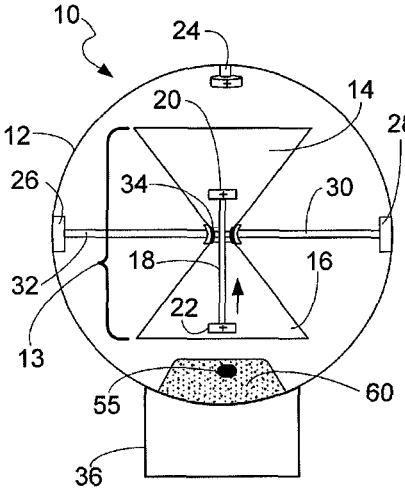
FIG. 1 shows a front side view of one potential embodiment of an inventive oscillating dual-chambered heat pump at an initial position prior to heat and pressure increase.
Figure 2:
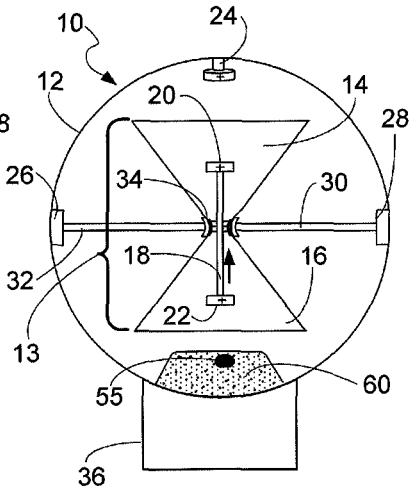
FIG. 2 shows the same heat pump of FIG. 1 in process of heat and pressure increase.
Figure 3:
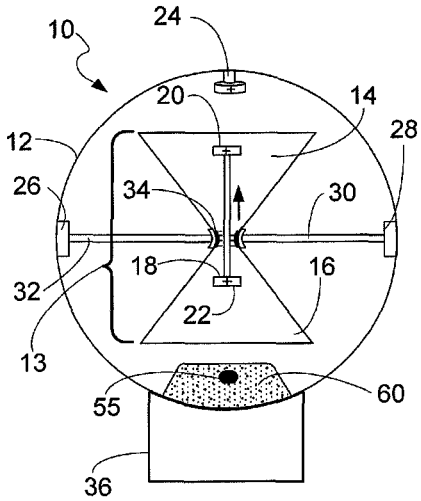
FIG. 3 shows the same heat pump of FIG. 2 in further progress of such heat and pressure increase.
Figure 4:
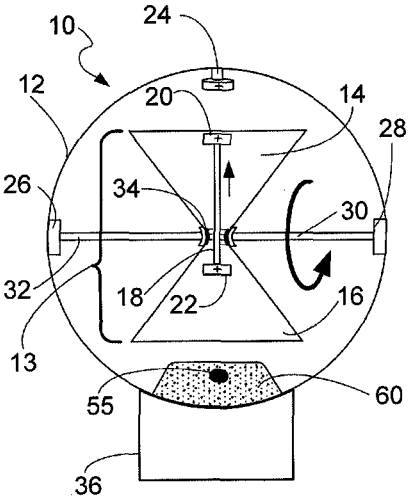
FIG. 4 shows the same heat pump of FIG. 3 at oscillation activation.

Thus, again, in non-limiting utilization as a heat pump device, FIGS. 1-4 show the same perspective view of one such structure 10 including a housing sphere 12, a heat collector base 36 on which such a sphere 12 is situated, and an hourglass 13 that oscillates back and forth around an axis 20, 32, and including a movable plunger device 18. Present within the bottom of the sphere 12 and over the collector 36 is a heat transfer gel 60 including metal beads, shards, etc., and a metal slug 55. The gel 60 permits greater reliability in terms of transfer of heat from the collector 36 to the hourglass 13. The metal slug 55 provides an attraction source for magnets 20, 22 on the plunger device 18 in order to align the hourglass 13 over the gel 60 during heat transfer. The metal beads, shards, etc., within the gel 60 accord both increased heat draw from the collector 36 as well as increased magnetic attraction for the magnets 20, 22 on the plunger 18. The sphere 12 further includes holders 26, 28 for the axle 30, 32, and a dedicated magnet set 24 (124, 124A of FIG. 6) at the top thereof opposite the gel 60 and collector 36. Thus, as heat is supplied to the collector 36, it transfers through the sphere 12 (which may include vents or other means to permit increases in heat transfer capability, if desired) and to the gel 60. Such a gel 60 is shown as a contained semi-solid within these depictions. If desired, however, a viscous gel may be introduced within the bottom portion of the sphere 12 to fill to a level that permits oscillation of the hourglass 13 and heat transfer activity. Upon transfer, then, of heat to the gel 60, the hourglass 13 receives a certain level of heat through the bottom of a lower chamber 16 (at least such a chamber is considered "lower" at the moment and during such heat transfer prior to an oscillation event of a half rotation of the hourglass 13). With the amount of heat transferred to such a "lower" chamber 16, the plunger device 18, which is provided in movable fashion through a properly sealed opening 34 (with the term "sealed" intended to indicate that the plunger is held at a certain pressure therein to permit the device to slide up and down therethrough; such an opening 34 may thus be of a rubber gasket type, or any other like type of structure and material that facilitates retention and movement of such a plunger 18 while preventing appreciable levels of heat escaping into the "upper" chamber 14). As greater amounts of heat are thus transferred, the plunger device 18 slides upward (as shown in FIGS. 2 and 3) until the "lower" chamber 16 reaches capacity and the plunger 18 is at its highest point within the "lower" chamber (FIG. 4). Simultaneously, then, the appropriate magnet 20 on the external end of the plunger 18 in the "upper" chamber 14 is in close enough proximity to the dedicated magnetic set 24 such that the configured magnets 24 act to repel and attract the plunger magnet 20 in the same direction (basically, one of the magnet set is positioned with a positive pole and the other is configured in the same manner; in this manner, with the plunger magnets 20, 22 positioned and configured in opposite directions, upon interaction with the magnet 24 the hourglass will be forced in one direction and upon interaction with the opposite plunger magnet, the hourglass will be forced back in the opposite direction. As noted above, upon rotation of the hourglass 13, there is a need to align the prior "upper" chamber 14 with the gel 60, in order to have the heat transfer operation occur with such a chamber 14 in which the plunger 18 is now present (after half-rotation oscillation) at a level closest to the gel 60. As such, the metal slug 55 provides (along with metal beads, shards, etc., within the gel 60, if desired) the potential to attract the magnet 20 on the plunger 18 for alignment purposes. As the operation continues, then, the magnets 20, 22 interact as appropriate with the dedicated magnet set 24 and, upon half rotation of the hourglass 13, the metal slug 55 helps to capture and align the appropriate hourglass chamber 14, 16 through attraction to the subject plunger magnet 20, 22. Thus, as this device only requires the exposure to a heat source for operation, the ability to oscillate based upon magnetic impulses applied to a plunger device at its apex during constantly motion activities, such a device will continue indefinitely until the latent heat level of the hourglass exceeds the heat level supplied thereto from the external collector.

Figure 5:
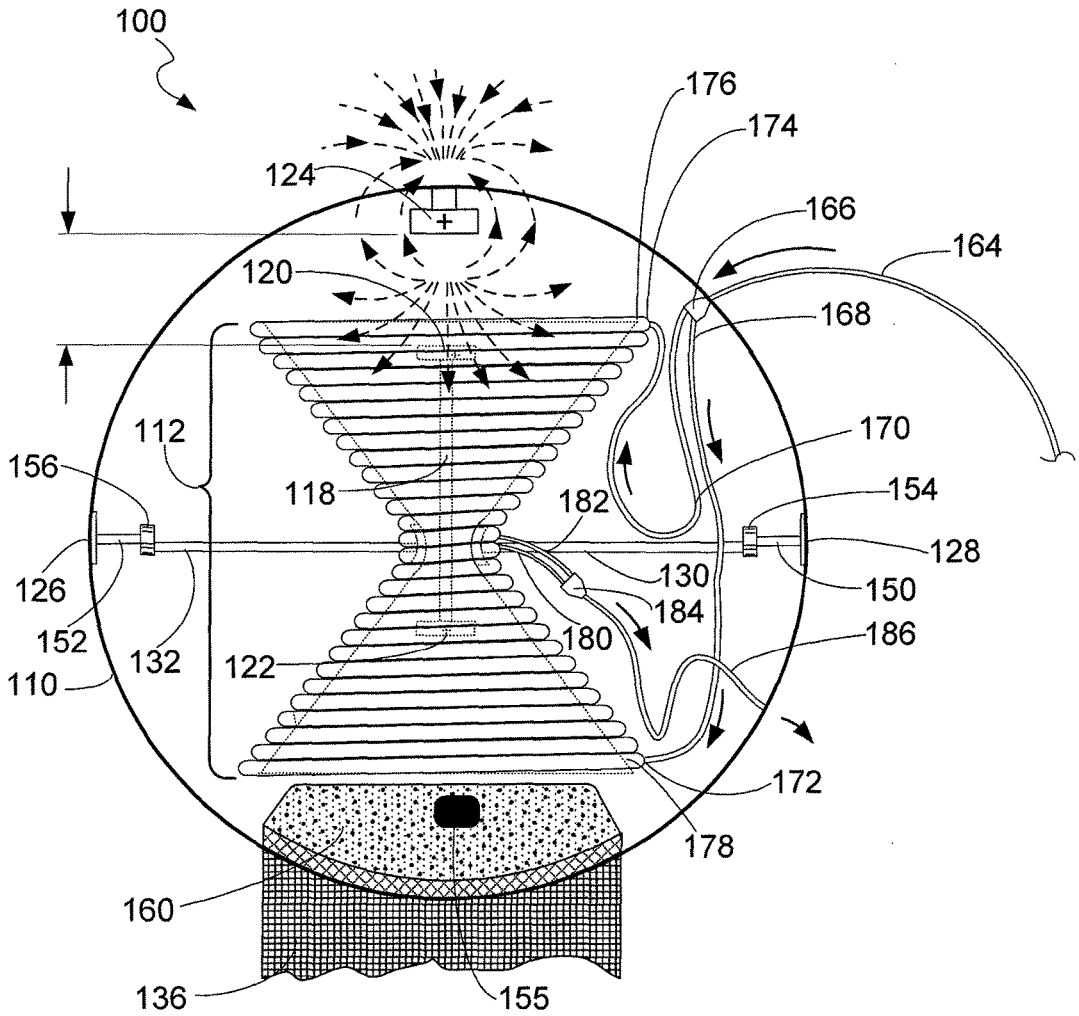
FIG. 5 provides a front side view of another potential embodiment of an inventive dual-chambered heat pump with fluid heat transfer coils present thereon.

FIG. 5 shows a similar device 100, with fluid transfer/heating tubes 176, 178 present on the external surfaces of the hourglass 112. An axle 130, 132 is provided with an extended holding component 154, 156 attached to separate rods 150, 152 and separate attachments 126, 128 on the inner surface of the sphere 110. A plunger 118 is present with magnetic ends 120, 122 that interact separately with a dedicated magnet set 124 upon achievement of the maximum height of the plunger 118 during heat transfer (as described above). A heat collector 136 thus transfer heat to the sphere 110, further to a gel 160 (with, here, metal beads, shards, etc., although such, as throughout these descriptions, are not required; the user may avoid utilization and presence of such components, if desired, in other words) with a metal slug 155 present therein. Thus, the operation of the hourglass 112, plunger 118, magnets 120, 122, magnet set 124, and metal slug 155, all work as described for the same types of components and materials in FIGS. 1-4, above. The transfer tubes 176, 178, then allow for water or other fluid to be introduced from a reservoir (188 in FIG. 8) thereto through a main tube 164 that passes through a valve 166 which controls pass-through of such fluid to both chambers through flexible tubes 172, 174. During heat transfer operation, then, the fluid within the tubes 172, 174 encircling both chambers 114, 116 is heated while the hourglass 112 receives sufficient heat to drive the plunger 118 upward. As the fluid reaches the middle portion of the hourglass 112 (and thus, the end of each tube 176, 178, egress tubes 180, 182 permits movement to another control valve 184 that permits the fluid to pass out of the sphere 110 and to a collection reservoir (189 of FIG. 8). As the hourglass 112 oscillates, then, the formerly "upper" chamber transfer tube 176 receives the fluid from a second tube 174 and it leads out through its own exit tube 182 and out of the sphere 110, as well. Thus, as the dual-chamber oscillating hourglass 112 operates in relation to heat transfer, fluid may be heated and collected simultaneously with an initial source transferred to the device 100 and out to a storage reservoir (189 of FIG. 8) for such a purpose. In this manner, basically, fluid volume is dependent on heat transferred into the coolant at issue, as well, that may determine the rate of movement through the tubes, as well.

Figure 9A:
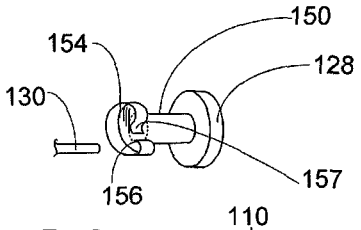
FIGS. 9A and 9B show axle connectors for the heat pump of FIG. 5.
Figure 9B:
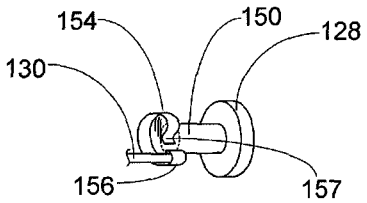
Figure 6:
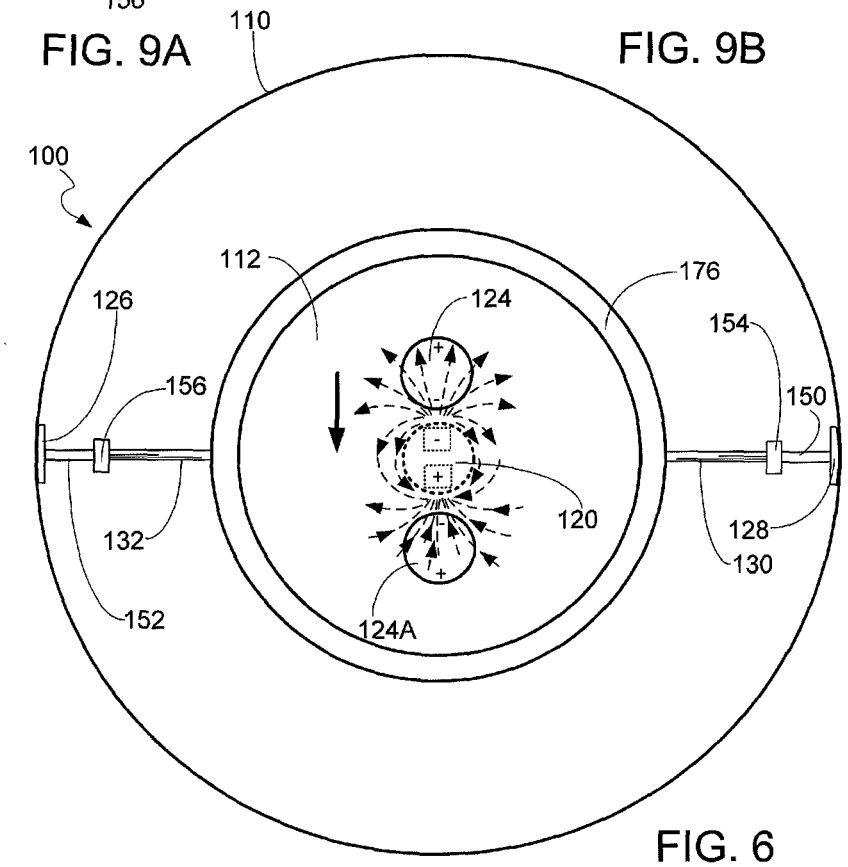
FIG. 6 provides a top view of the heat pump of FIG. 5.

FIG. 6 allows for a closer view of the dedicated magnet set 124, 124A. As the plunger magnet 120 rises to its apex, the polarity supplied therein interacts with the opposing magnets 124, 124A to cause repulsion by the, in this instance, negatively charged poles and attraction by the negative and positive charged poles. Thus, the hourglass 112 will, in this situation, be forced in a direction downward around the axle 130, 132. The opposing end of the plunger (118 in FIG. 5) is thus configured in opposite fashion as to magnetic polarity to allow for repulsion and attraction in the opposite direction (upward and around the axle 130, 132, for instance). The axle 130, 132 is shown, as well, in FIGS. 9A and 9B within catch devices 154 that allow for rotation of the hourglass (112 of FIG. 6). Such a catch device 154 include a lower lip hold 156 to ensure the axle 130 snaps into place for security purposes, but may be removed, if necessary, for upkeep and maintenance. There is thus also holding rod 150 bridging the catch device 154 to a sphere surface attachment 128 to allow for facilitated movement and, if necessary, removal of the hourglass (112 of FIG. 6), as well.

Figure 7:
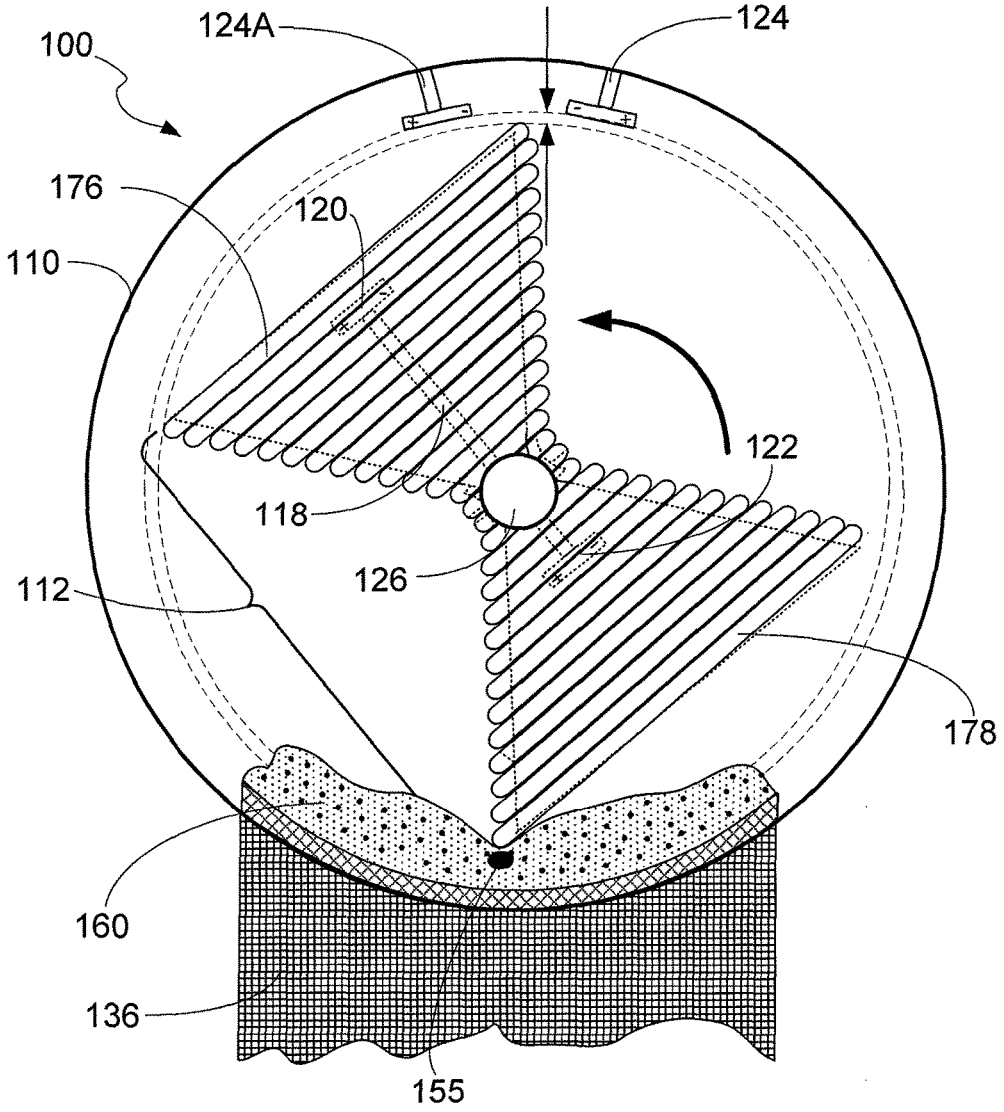
FIG. 7 shows a side view of the heat pump of FIG. 5 during a single oscillation.
Figure 8:
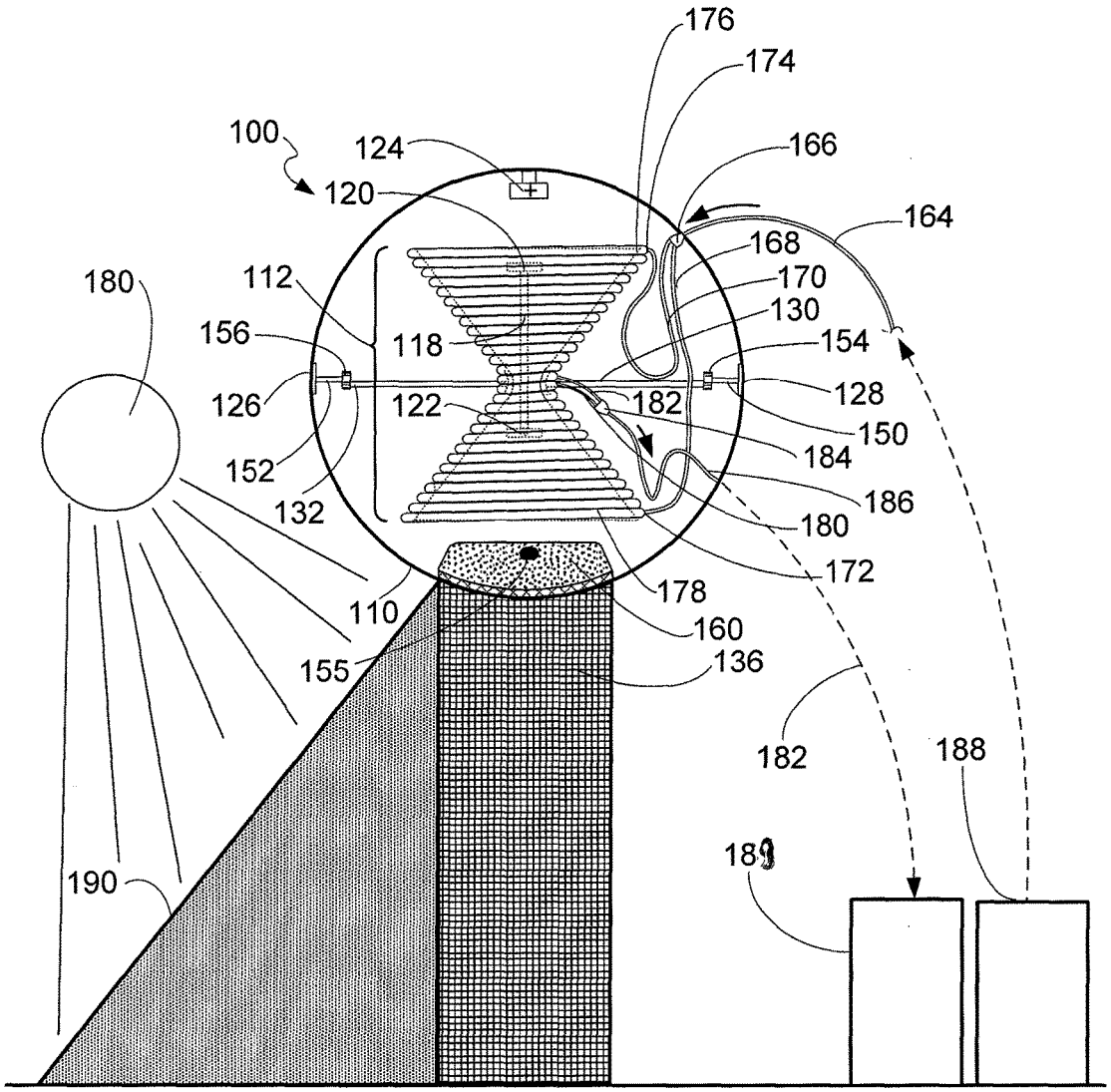
FIG. 8 is a front view of the heat pump of FIG. 5 situated on a solar collector and with water reservoirs attached thereto.

FIG. 7 provides a side view of an oscillating operation for the device 100 of FIG. 6. At this point, the plunger 118 has been forced upward through heat and pressure to its apex within the "lower" chamber and close enough for interaction between the plunger magnet 120 and the dedicated magnet set 124, 124A. Once the magnets 120, 124, 124A act in such a manner (simultaneously repulsion and attraction in the same direction, as shown by the arrow), the hourglass 112 rotates through the gel 160 in relation to the axle (130, 132 of FIG. 6) centered by the sphere side attachment 126. The rotation continues until the "upper" tube 176 is aligned over the gel 160, potentially through attraction to the charged metal slug 155 therein. FIG. 8 thus provides a possible embodiment of a self-contained, automatic oscillating device 100 for the provision of heated fluid. A source reservoir 188 supplies such a fluid (such as water, as one non-limiting example) through an ingress tube 164 to a control valve 166 that splits into separate tubes 168, 170 leading to heat transfer tubes 176, 178. The sun 180 thus provides solar heat and energy to an base collector 190 that transfers to a directed collector 136 to the sphere 110 and to the gel 160. As above, the supply of heat in this manner provides simultaneous movement upward of the plunger 118 and increase in thermal energy to the fluid within the appropriate transfer tube 176, 178. With the plunger 118 moving as described herein, the magnets 120, 122 interact with the magnet set 124 and the metal slug 155 for the purposes explained herein. The continued oscillation back and forth of the hourglass 112 thus permits automatic and continuous (as well as limitless) heat pump and fluid transfer capability. The plunger 118 may also be configured in such a manner as to provide such a water pump capacity. For instance, in FIG. 12 the plunger 18 has not only ends 20, 22 exhibiting certain polarity results, but alternating polar regions through the plunger 18 itself, permits a fluid drive mechanism in relation to the egress tubes 180, 182 from the transfer tubes 176, 178. Thus, again, a self-contained, non-electrical unit may be provided for this continual operation. Additionally, as should be easily understood by the ordinarily skilled artisan, the heat source for such operations need not rely solely upon solar energy. Any heat source, whether environmental in nature (hot springs, volcanic heat, desert heat, even simple summer heat sources, etc.) or manmade (such as, as non-limiting examples, waste heat in power plants, manufacturing plants, flame sources, and the like), may be utilized for this purpose. As well, as noted previously, although these Figures provide a fluid heat transfer method, such a device 100 may be employed for any purpose, including power generation and fluid transfer alone, as non-limiting examples.

Figure 10:
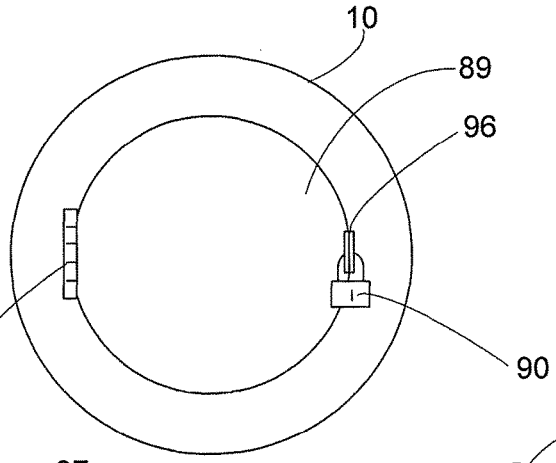
FIG. 10 shows a rear view of a potentially preferred sphere housing for an inventive heat pump.
Figure 11:
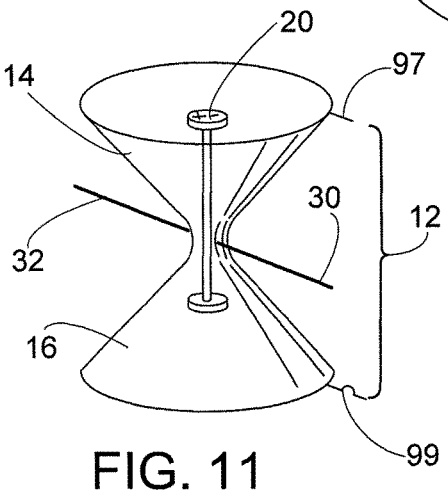
FIG. 11 provides a perspective view of a potentially preferred hourglass-shape dual-chambered heat pump component of the instant invention.
Figure 13:
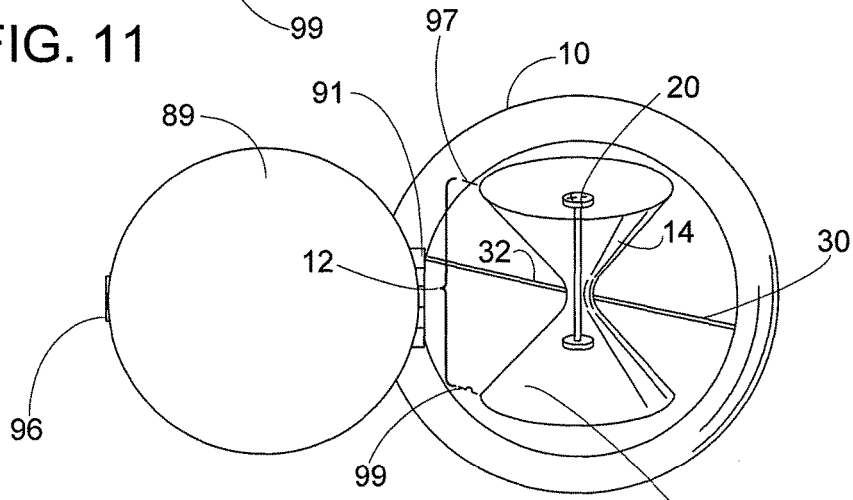
FIG. 13 provides a perspective view of the combination of FIGS. 10 and 11 with the sphere housing open.

FIG. 10 shows the sphere 10 alone from a rear perspective. To provide security in terms of operations, and thus the ability to prevent unwanted intrusions, the sphere 10 may be outfitted with a lock 90. For access purposes, certainly, a swinging door 89 is provided with a hinge 91 and a latch 96 (through the lock 90 is introduced. FIG. 11 shows a possible hourglass 12 for placement within such a sphere (10 of FIG. 10). Such an hourglass 12 includes the axles 30, 32, a "lower" chamber 16, an "upper" chamber 14 (again, "lower" and "upper" only indicate positioning subsequent to an oscillation event, not that these chambers are static and thus always considered to be in one single position at all times). The plunger 18 is provided with the opening 34 and magnetic ends 20, 22, as well. Additionally, in this embodiment, the hourglass 12 includes opposing extending arms 97, 99. A first arm 97 extends directly out perpendicularly from the "upper" chamber 14; a second arm 99 extends directly out perpendicularly form the "lower" chamber 16. These arms 97, 99 are utilized to ensure rotation of the hourglass 12 does not pass too far for alignment over the heat collector (36 of FIG. 1) and/or gel (60 of FIG. 1). The second arm 99 is provided with a middle half-moon shape that is noticeable different from the structure of the first arm 97. Such differences allow for pegs (such as 238 and 240 in FIG. 14) to be supplied within the sphere (210 of FIG. 14) to catch such a hourglass 12 that has rotated too far in one direction without interfering with the rotation thereof in the opposite direction. FIG. 13 shows the placement of such an hourglass 12 within a sphere 10 with the door 89 opened. As noticed, the door 89 is not provided directly in the middle of the sphere 10. Such a configuration thus permits an offset positioning of the hourglass 12 within the sphere 10 to allow for free rotational movement as needed while still according proper access in a secure fashion as needed for maintenance, etc., of the overall device.

Figure 12:
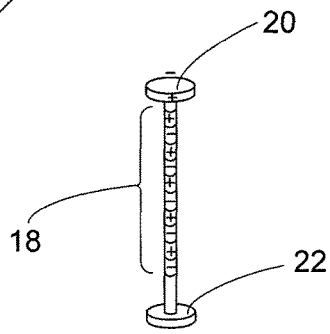
FIG. 12 shows a view of a potentially preferred heat pump plunger component.
Figure 14:
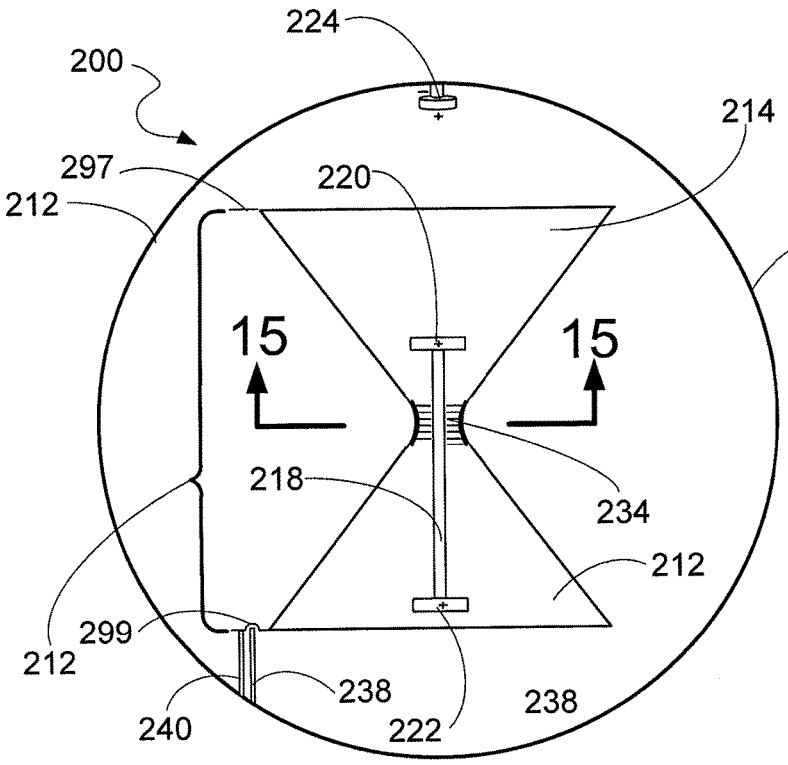
FIG. 14 shows another possible embodiment of an inventive dual-chambered heat pump with catch pegs and arms present for positioning purposes during and after oscillation.
Figure 16:
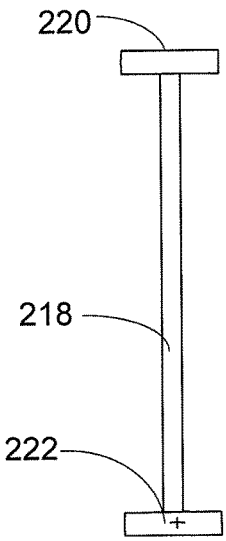
FIG. 16 is a side view of the plunger device of FIG. 15.
Figure 15:
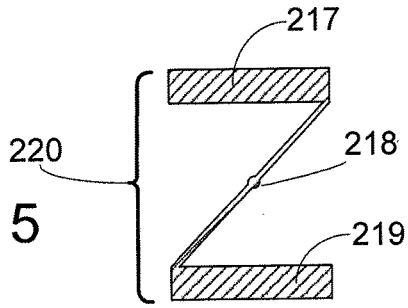
FIG. 15 is a cross-sectional view of a portion of a potentially preferred plunger device provided as lines 15-15 in FIG. 14.
Figure 17:
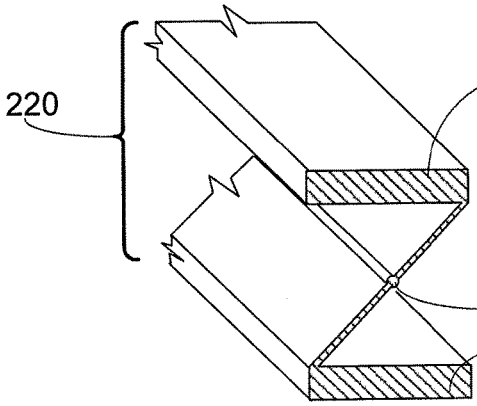
FIG. 17 is a top perspective view of the plunger device of FIG. 15.
Figure 18:
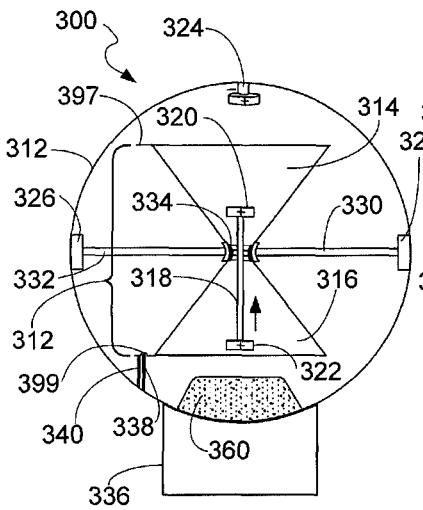
FIG. 18 is a front side view of another potentially preferred oscillating dual-chamber heat pump with the hourglass and sphere components of FIG. 14 at an initial position prior to heat and pressure increase.
Figure 19:
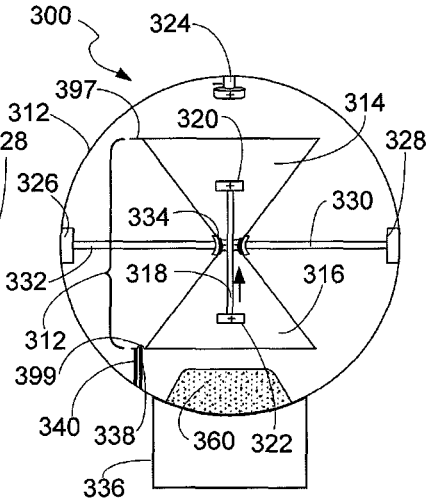
FIG. 19 shows the same heat pump of FIG. 18 in process of heat and pressure increase.
Figure 20:
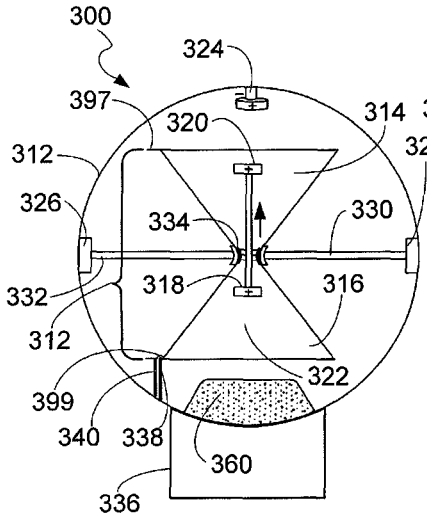
FIG. 20 shows the same heat pump of FIG. 19 in further progress of such heat and pressure increase.
Figure 21:
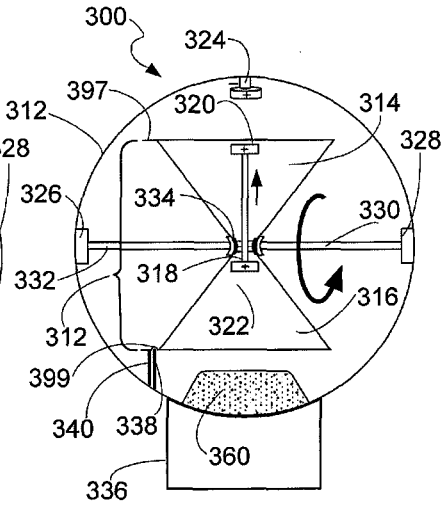
FIG. 21 shows the same heat pump of FIG. 20 at oscillation activation.
Figure 23:
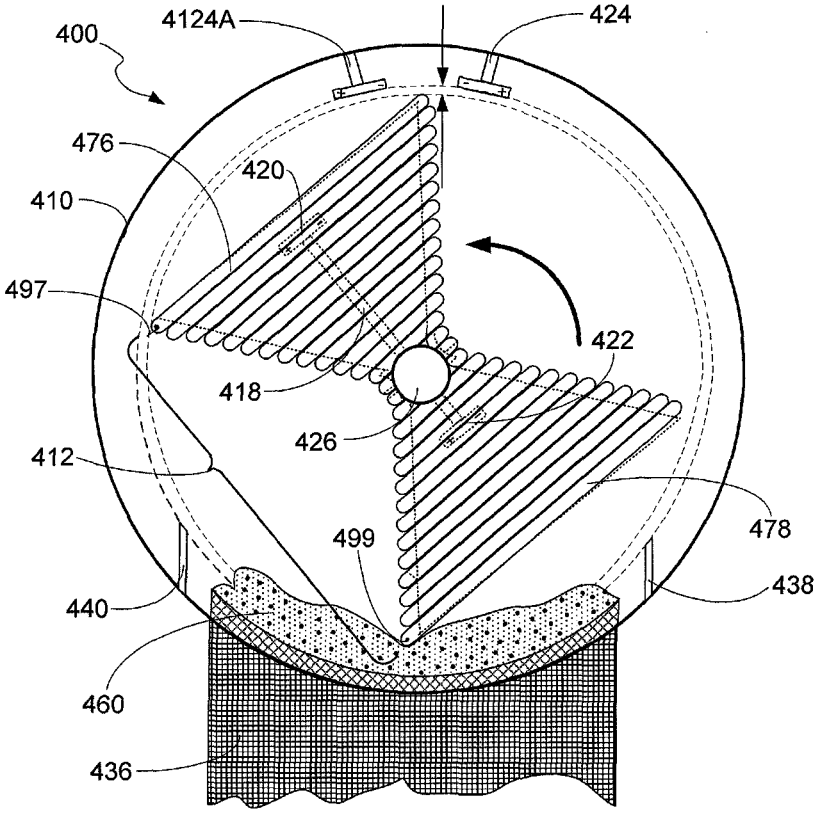
FIG. 23 shows a side view of the heat pump of FIG. 22 during a single oscillation.
Figure 24:
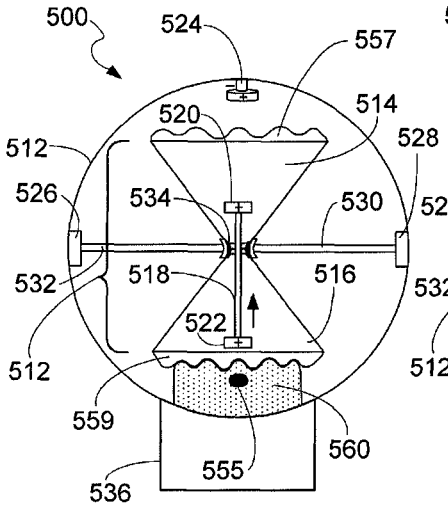
FIG. 24 is a front side view of another potentially preferred oscillating dual-chamber heat pump including an hourglass with external fin extensions at an initial position prior to heat and pressure increase.

FIG. 14 accords a different embodiment for the inventive device 200 wherein the hourglass 212 includes extended side arms 297, 299 (as described in FIG. 11, above, for instance). The sphere 210 includes separate pegs 238, 240 that are actually set on opposing sides of the inner surface of the sphere 210 (such as 438 and 440 in FIG. 23) and at different distances from the edges of the hourglass 212. The first arm 297 is straight and extends a certain distance and at a height that will contact the first peg 238 when such a first arm 297 rotates in such a fashion. Likewise, the second arm 299 is a partially half-moon shaped structure that is of a length that will contact the second peg 240 when rotated in such a fashion, but, with the height and positioning of the half-moon component therein, will avoid any contact with the first peg 238 if and when rotated in such a fashion. The first arm 297 is of a length that will not contact the second peg 240 at its set position, either. Thus, when rotating, such an hourglass 12 can be rotated only a certain distance until contacting either the first arm 297 or the second arm 299, thereby ensuring that half-rotation will be effective for this purpose. Thus embodiment thus also includes an "upper" chamber 214 (that includes the perpendicularly extending first arm 297), a "lower" chamber (including the second arm 299), and a plunger 218 with magnetic ends 220, 222 that interacts with a dedicated magnet set 224 in the top portion of the sphere 210. The axle 230, 232 is also present to accord the rotational capability of the hourglass 212. Lines 15-15 herein are further explained in relation to another potential embodiment of the plunger 218. Since the plunger 218 is, for instance, as shown in FIG. 12, a cylindrical shape, there does exist the potential for uneven tilting or misalignment of the plunger 218 during operation. FIG. 15, which provides a cross-sectional view of the plunger 218 in this instance, shows a Z-shape structure 220 having a first side 217 and a second side 219 separated by a middle portion 218. In this manner, greater control over the alignment of the plunger 218 may be provided such that the sliding orientation is permitted with minimal tilt to either side. FIG. 16 provides the overall plunger shape 218 as in FIG. 14 with the added magnetic ends 220, 222 supplied. FIG. 17 shows a perspective view of the plunger 218 as in FIG. 15. Certainly, if desired, a Z-shape may be modified to a V-shape without appreciable loss of orientation control during operation by removing, for instance, top side 217. In any event, alternate structures for the plunger 218 may be undertaken for this purpose.

FIGS. 18-21 show another possible embodiment for the device 300 with a sphere 310 including catch pegs 338, 340 in complementary relation to first and second arms 397, 399, respectively, extending from the hourglass 312. The magnet set 324 interacts, as described throughout, with the magnet ends 320, 322 of the plunger 318, which moves through a "sealed" opening 334. Upon such interaction, the hourglass 312 rotates upon attraction/repulsion from the magnet set 324 upon the plunger magnet ends 320, 322. Such rotation occurs around an axle 330, 332, that is attached to sphere-surface holding components 326, 328. With a gel 360 supplied within the sphere 310 for heat transfer potential, the initiation of thermal energy to a heat source collector 336 thus starts the movement of the plunger 318 upward in relation to heat and pressure within the "lower" chamber 316 of the hourglass 312. The action of the plunger 318 (as in FIGS. 19 and 20) leads to full movement thereof in FIG. 21, which raises the plunger magnet 320 to the appropriate height within the "upper" chamber 314 to interact with the magnet set 324, thus causing the hourglass 312 to then start rotating.

Figure 22:
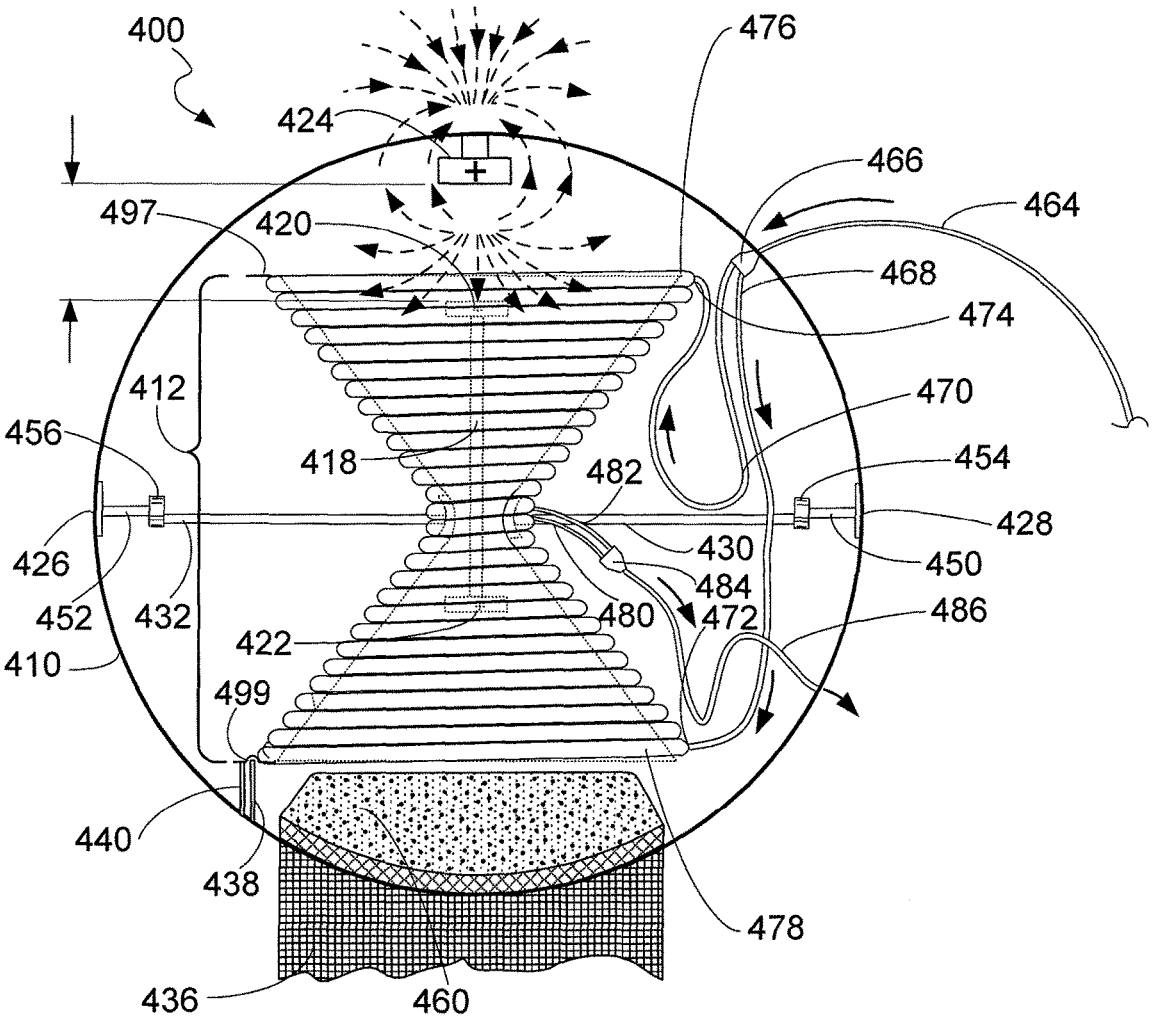
FIG. 22 provides a front side view of another potential embodiment of an inventive dual-chambered heat pump including the components of FIG. 14 with fluid heat transfer coils present thereon.

Such a device 400 including a sphere 410 with catch pegs 438, 440 is shown in FIG. 22, with the added heat transfer tubes 476, 478 to the hourglass surface 412 for fluid transfer and heating purposes. The ingress tube 464 supplies the fluid (water, for instance) to the control valve 466 that allows for transfer to both transfer tubes 476, 478 via initial tubes 472, 474 and transferred through with heat transfer from the heat introduced within the hourglass 412. As above, with the plunger 418 moving in relation to the actual heat levels transferred to the appropriate hourglass chamber, the eventual rise in height of the plunger 418 for interaction between the magnet set 424 and the plunger magnets 420, 422, accords the rotational movement initiation. With the catch pegs 438, 440 and extended hourglass arms 497, 499 in place, such rotation will not exceed the desired distance and alignment over the desired gel 460 is thus possible in an automatic fashion. Such rotation is accomplished via the axle 430, 432, which is attached to catch devices 454, 456, which, in turn, are attached to opposing rods 450, 452 attached to sphere side holds 426, 428. As the fluid moves through the transfer tubes 476, 478, it reaches the egress tubes 480, 482 which lead to a second control valve 484 leading to an exit to a reservoir for the heated fluid. Such rotation is provided in snapshot form in FIG. 23 with such an action captured in mid-movement. In this manner, the second arm 499 will avoid the first peg 440 upon rotation and, if the hourglass 412 moves too far, the first arm 497 will contact the first arm 440 and move back to alignment over the gel 460 and heat collector 436. Likewise, the first arm 497 will avoid contact with the second arm 438 during such rotation. Of course, upon return in the opposite direction, the second arm 499 would contact and correct via the second arm 438 and avoid the first arm 440, while the first arm 497 will avoid the second arm 438. The flexibility of the gel 460 further permits such rotational movement without appreciable friction levels, thus, again, permitting such continual action in relation to the magnetic impulses supplied by the magnet set 424, 424A to the plunger magnets 420, 422.

Figure 25:
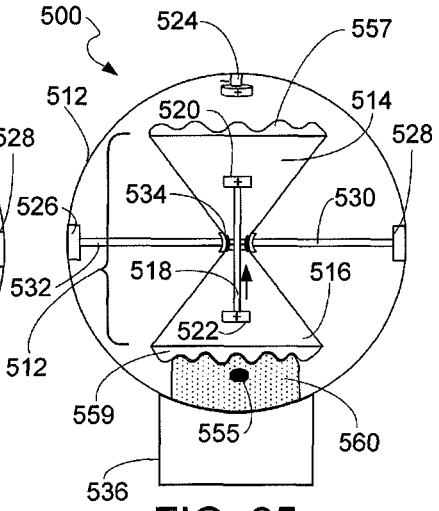
FIG. 25 shows a front side view of the heat pump of FIG. 24 in process of heat and pressure increase.
Figure 26:
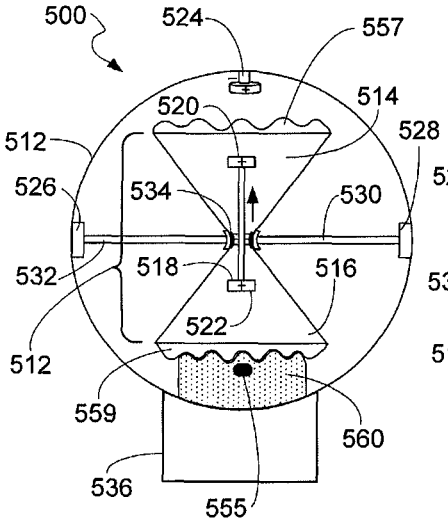
FIG. 26 shows the same heat pump of FIG. 25 in further progress of such heat and pressure increase.
Figure 27:
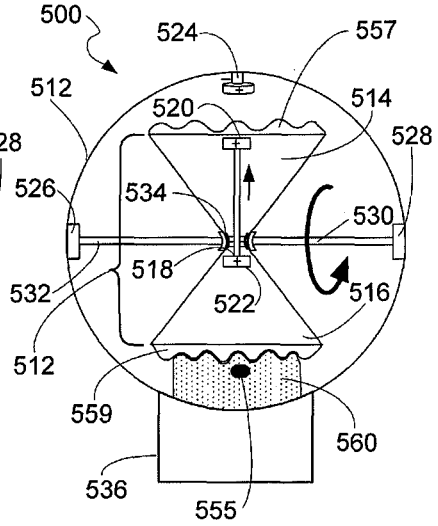
FIG. 27 shows the same heat pump of FIG. 26 at oscillation activation.

Yet another possible device 500 is shown in FIGS. 24-28, utilizing heat transfer extending fins 557, 559 present on the opposing chambers 514, 516 of the hourglass 512. The sphere 510 includes the same magnet set 524 as before, as well as the holding components 526, 528 attached to the axle 530, 532 that accords the rotation of the hourglass 512. The plunger 518 is likewise structured as before with the magnetic ends 520, 522 to interact with not only the magnet set 524, but also a charged metal slug 555 within a heat transfer gel 560. Such a gel 560 is also supplied, potentially, with channels that conform, at least to a certain extent, with the shape of the extended fins 557, 559 of the hourglass 512. In this manner, as the hourglass 512 rotates, the fins 557, 559 are not impeded by the gel 560 and, upon alignment between the plunger 518 and the metal slug 555, the increase in surface area provided by the fins 557, 559 accords increased heat transfer capability to the hourglass 512 for more efficient operations. Such fins 557, 559, may be of proper material for this purpose, as described above. With the heat collector 536 in place, then, the transfer of heat through the sphere 510 to the gel 536 continues to the fins 557, 559 of the hourglass 512 and then to the appropriate chamber 514, 516 for the plunger 518 to then begin movement upward. As before, once the plunger 518 reaches its apex, the magnet set 524 supplies magnetic boost to the magnet end 520, 522 to initiate the rotation of the hourglass 512 around the axle 530, 532. FIGS. 25 and 26 show the rising plunger 518 and FIG. 27 shows the magnetic interaction and start of rotation in this manner.

Figure 28:
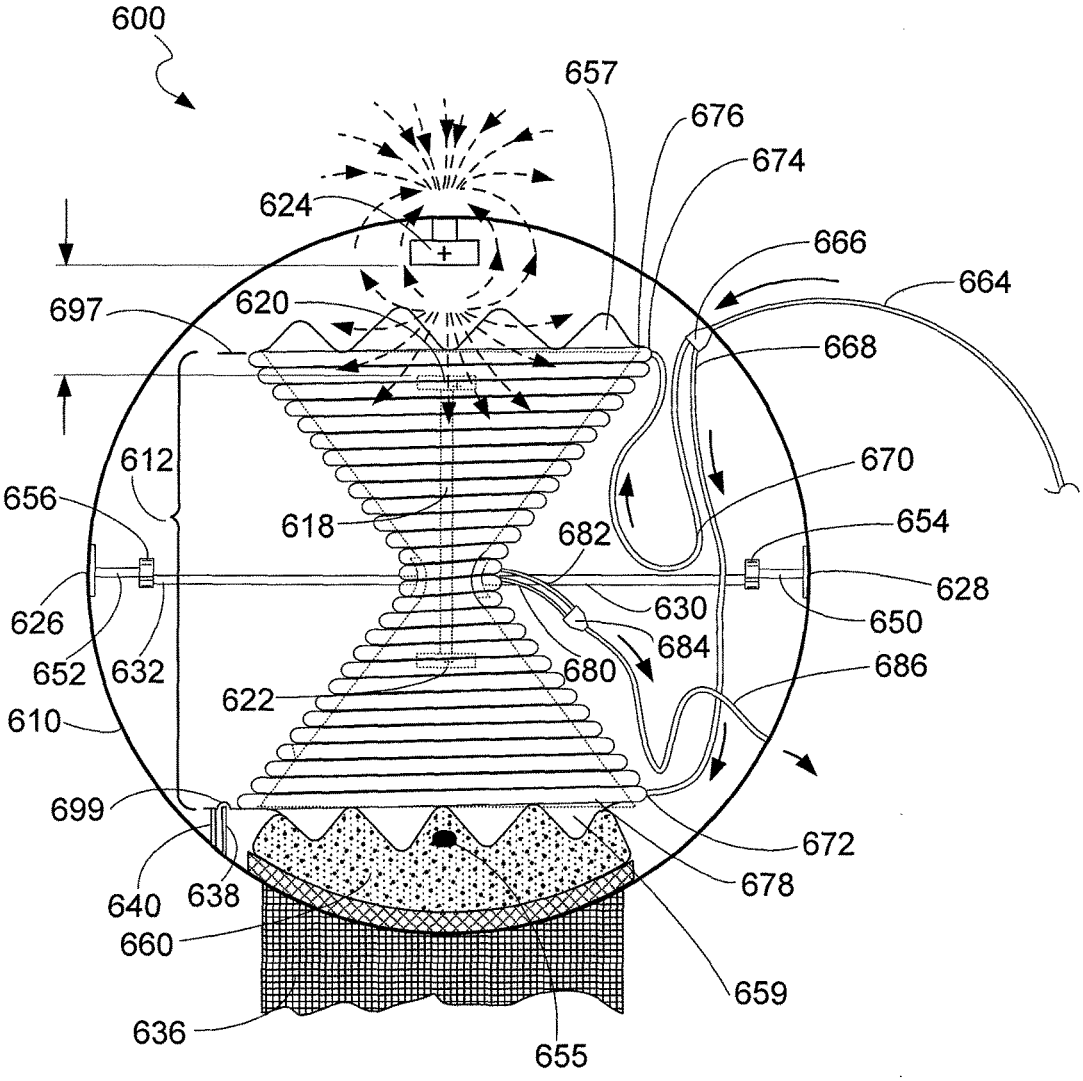
FIG. 28 provides a front side view of another potential embodiment of an inventive dual-chambered heat pump including external fin extensions and with fluid heat transfer coils present thereon.
Figure 29:
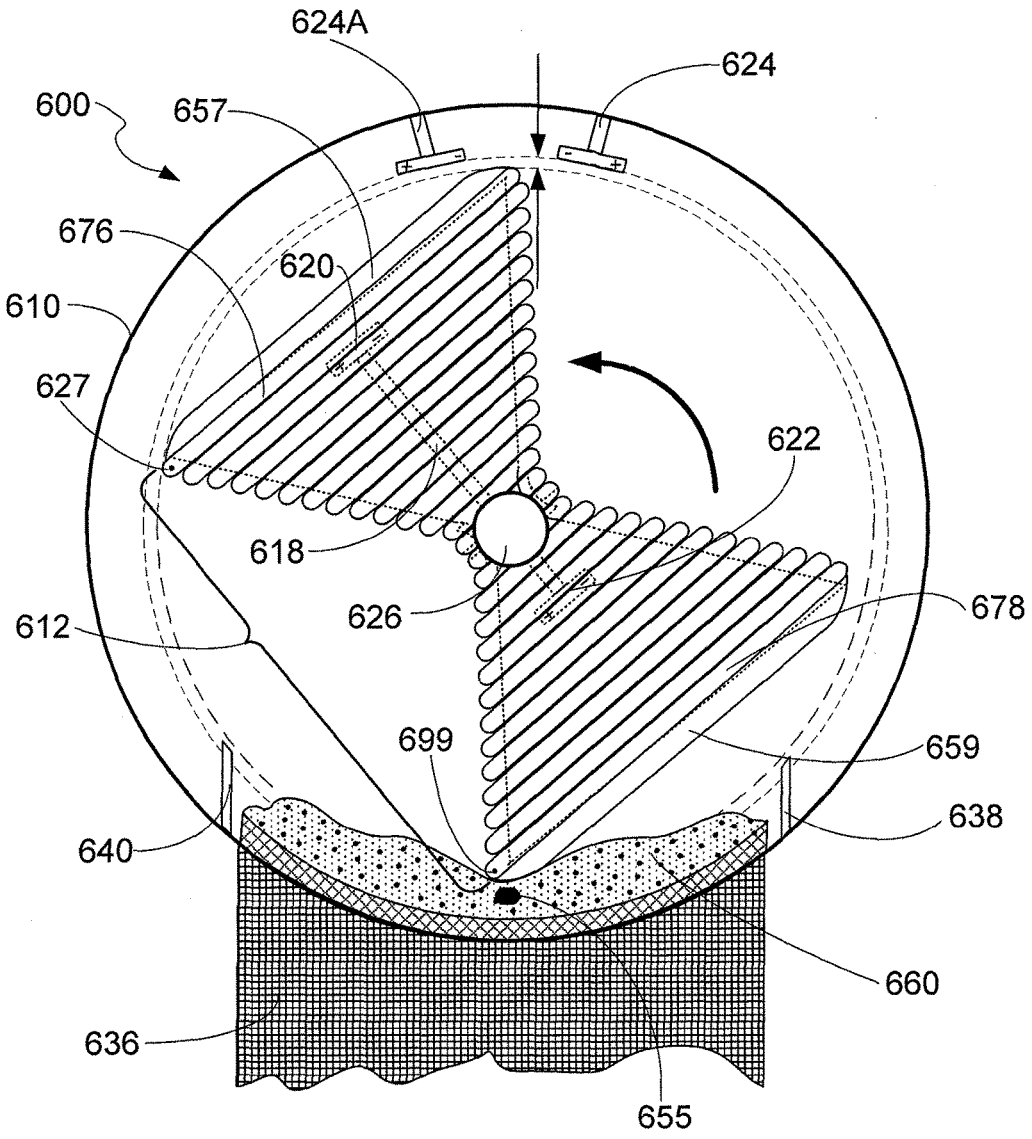
FIG. 29 shows a side view of the heat pump of FIG. 28 during a single oscillation.

FIG. 28 provides a view of another possible embodiment of the device 600 including a sphere 610 with catch pegs 638, 640, with the added heat transfer tubes 676, 678 on the hourglass surface 612 for fluid transfer and heating purposes, as well as heat transfer fins 657, 659 on the hourglass 612, too. For fluid transfer capabilities, the ingress tube 664 supplies the fluid (water, for instance) to the control valve 666 that allows for transfer to either the "lower" transfer tube 678 via a first tube 672 or the "upper" transfer tube 676 through a second tube 674, with heat transferred to both (with the "lower" chamber tube 672 heated to a quicker degree) through the heated introduced within the hourglass 612. As above, with the plunger 618 moving in relation to the actual heat levels transferred to the appropriate hourglass chamber, the eventual rise in height of the plunger 618 for interaction between the magnet set 624 and the plunger magnets 620, 622, accords the rotational movement initiation. With the catch pegs 638, 640 and extended hourglass arms 697, 699 in place, such rotation will not exceed the desired distance and alignment over the desired gel 660 is thus possible in an automatic fashion. Such rotation is accomplished via the axle 630, 632, which is attached to catch devices 654, 656, which, in turn, are attached to opposing rods 650, 652 attached to sphere side holds 626, 628. As the fluid moves through the transfer tubes 676, 678, it reaches the egress tubes 680, 682 which lead to a second control valve 684 leading to an exit to a reservoir for the heated fluid. Such rotation is provided in snapshot form in FIG. 29 with such an action captured in mid-movement. In this manner, the second arm 699 will avoid the first peg 640 upon rotation and, if the hourglass 612 moves too far, the first arm 697 will contact the first arm 640 and move back to alignment over the gel 660 and heat collector 636. Likewise, the first arm 697 will avoid contact with the second arm 638 during such rotation. Of course, upon return in the opposite direction, the second arm 699 would contact and correct via the second arm 638 and avoid the first arm 640, while the first arm 697 will avoid the second arm 638. The flexibility of the gel 660, as well as the presence of heat transfer fins 657, 659 on the hourglass 612, further permits such rotational movement without appreciable friction levels, thus, again, permitting such continual action in relation to the magnetic impulses supplied by the magnet set 624, 624A to the plunger magnets 620, 622.

Thus, with these non-limiting descriptions and embodiments, it should be clear that the user may simply expose these devices to appropriate heat sources for heat transfer to commence. Thereby, the oscillating operations will continue indefinitely and without any need for any other power supply (electrical, mechanical, or otherwise), as the self-contained units do not require any further actions to achieve the desired results. The addition of a dynamo (or a plurality of such devices) to the hourglass or around additional magnets attached to the axle may provide appreciable electrical generation, on a sufficient large scale for utilization thereof. As well, there could be utilized a combination of applications may allow seawater to be pumped inland, then filtered in solar powered desalinization facilities, providing very low cost potable water in desert and marsh areas.

Such accompanying drawings thus show the basic potential accorded to propulsion and directional effects through the utilization of selected rotational path operations of gyroscopes provided on base wheel structures in this manner. Thus, the preceding examples are set forth to illustrate the principles of the invention, and specific embodiments of operation of the invention. The examples are not intended to limit the scope of the method. Additional embodiments and advantages within the scope of the claimed invention will be apparent to one of ordinary skill in the art.

What I claim is:

1. A heat transfer system comprising:

an oscillating dual-chambered device that automatically switches from positions in terms of disposition of one chamber vertically aligned and above the other chamber dependent upon the collection and absorption of heat by the lower vertically aligned chamber until such lower vertically aligned chamber absorbs sufficient heat to generate a pressure differential between itself and the upper vertically aligned chamber, whereupon said chambers rotate and switch positions until that lower chamber attains the necessary pressure level to activate the rotation to its initial position;

wherein said device includes a coolant line around both chambers that absorbs substantially all the heat collected within the lower aligned chamber at one time after said chamber has rotated to its upper position, wherein said dual-chambered device includes an activated plunger that oscillates back and forth dependent on said pressure differentials due to such heat level differences between the two chambers.

2. The system of claim 1 wherein said plunger includes two opposing magnetic structures on opposite ends that acts in concert with an external magnetic switch to release said oscillating dual-chambered device to permit rotation and catch thereof until said magnetic switch is activated upon sufficient magnetic signal from said plunger subsequently.

3. The system of claim 1 further including a coolant line that permits a single direction of coolant movement into and then out of said device, wherein said line wraps around said dual-chambered device to allow for heat transfer from said device to said coolant line.

4. The system of claim 1 further including a multi-rod heat collection device disposed, at all times, below said dual-chambered device.

5. A method of effectuating proper heat transfer from a heat source utilizing the system of claim 1, wherein said system includes a heat collection device that transfers heat to said lower aligned chamber of said dual-chambered, rotatable device, that transfers heat to said coolant line, that transfers heat to said coolant, wherein said heated coolant is then stored within a reservoir.

* * * * *